US007201631B2

(12) United States Patent
Thepot et al.

(10) Patent No.: US 7,201,631 B2
(45) Date of Patent: Apr. 10, 2007

(54) AUTOMATIC OR SEMI-AUTOMATIC DEVICE FOR TRIMMING AN OPHTHALMIC LENS

(75) Inventors: James Thepot, Asnieres (FR); Laurent Guillermin, Paris (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 419 days.

(21) Appl. No.: 10/479,414

(22) PCT Filed: Jun. 5, 2002

(86) PCT No.: PCT/FR02/01918

§ 371 (c)(1),
(2), (4) Date: Dec. 3, 2003

(87) PCT Pub. No.: WO02/098606

PCT Pub. Date: Dec. 12, 2002

(65) Prior Publication Data

US 2004/0142642 A1 Jul. 22, 2004

(30) Foreign Application Priority Data

Jun. 5, 2001 (FR) ..... 01 07315

(51) Int. Cl.
*B24B 49/12* (2006.01)
*B24B 9/14* (2006.01)

(52) U.S. Cl. ..... 451/5; 451/43

(58) Field of Classification Search ..... 451/42, 451/43, 44, 6, 255, 256
See application file for complete search history.

(56) References Cited

U.S. PATENT DOCUMENTS 4,737,918 A * 4/1988 Langlois et al. ..... 700/164

FOREIGN PATENT DOCUMENTS

| | | |
|---|---|---|
| EP | 0 990 484 | 4/2000 |
| EP | 1 093 907 A2 | 4/2001 |
| JP | 07-186027 | 7/1995 |
| JP | 7-186027 | 7/1995 |
| JP | 9-183052 | 7/1997 |
| WO | WO 01/45896 | 6/2001 |

* cited by examiner

*Primary Examiner*—Robert A. Rose
(74) *Attorney, Agent, or Firm*—Young & Thompson

(57) ABSTRACT

Device comprising in combination: elements for detecting (4) characteristics of a lens; elements for integrating characteristics representing a patient's morphology; a support (3) of the mobile lens along a predetermined trajectory between a first measuring position and a loading position; grinding elements (20); and elements forming a gripping and clamping clip (25) for transporting the lens from the loading position to the grinding position.

27 Claims, 3 Drawing Sheets

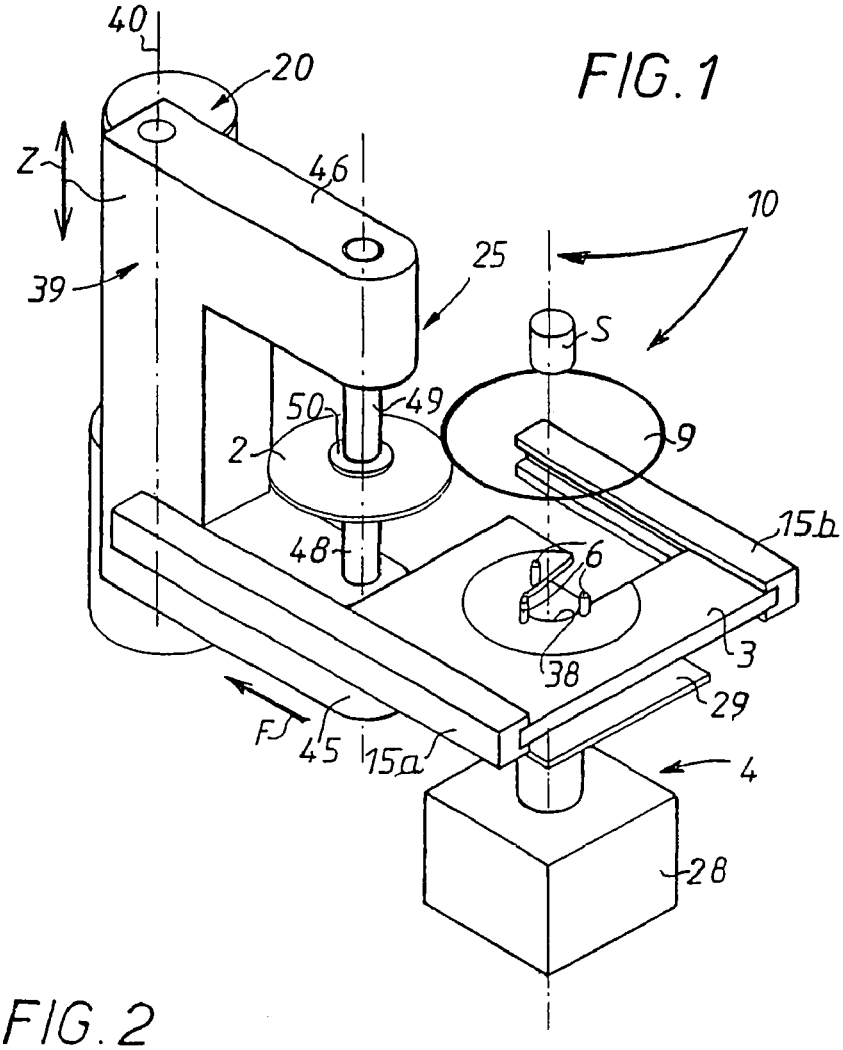
FIG. 1
FIG. 2
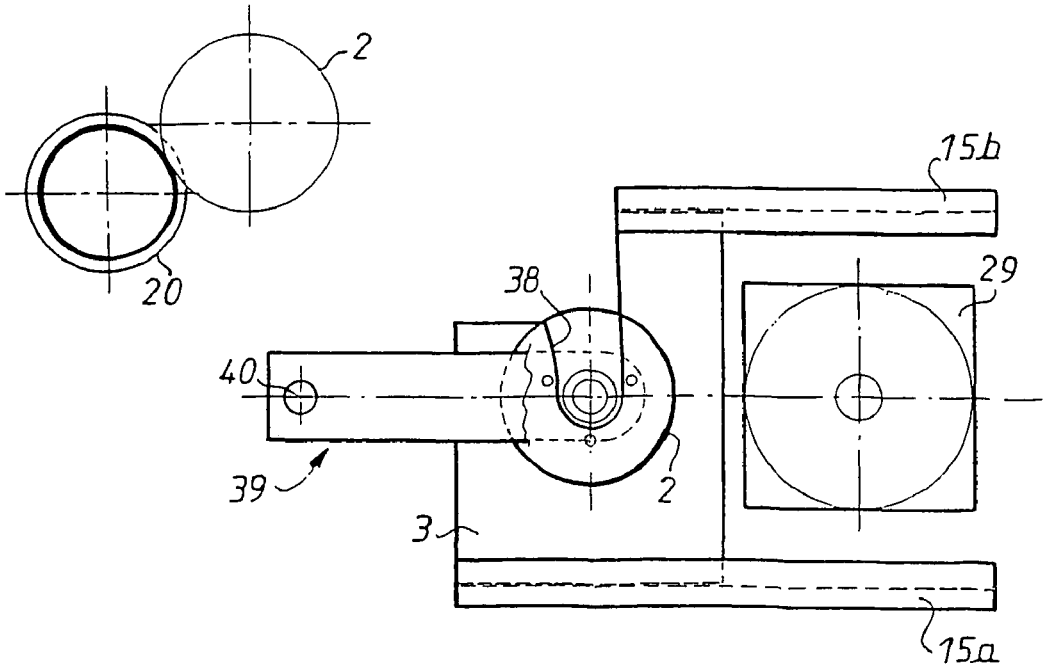

AUTOMATIC OR SEMI-AUTOMATIC DEVICE FOR TRIMMING AN OPHTHALMIC LENS

The invention relates to an ophthalmic lens trimming device and more particularly to an improvement to automate taking up and manipulation of the lens between, firstly, a position at which its optical characteristics can be determined using appropriate measurement means to determine a holding point on said lens and, secondly, the trimming means. The latter typically consist of a grinding wheel adapted to modify the contour of the lens to adapt it to that of the rim of a selected frame.

The technical aspect of the optician's profession consists in placing an ophthalmic lens in each rim of the frame selected by the wearer. This entails a certain number of operations.

First of all, after a frame has been chosen, the optician must situate the position of the pupil of each eye in the frame of reference of the frame, thereby determining two parameters related to the morphology of the wearer, namely the interpupillary distance and the height of the pupil relative to the frame.

With regard to the frame itself, it is necessary to identify its shape, which is generally done using a template or a device specifically designed to read the internal contour of the rim of the frame (i.e. of the surround of the lens).

The optician must also carry out a certain number of operations on the lens itself, before trimming, to locate certain of its characteristics, such as the optical center (in the case of a monofocal lens), for example, or the direction of the progression axis and the position of the centering point in the case of a progressive lens. In practice, the optician transfers certain characteristic points onto the ophthalmic lens itself using a fine-point marker. These marks are used to fix a centering and driving pin to an ophthalmic lens for positioning the lens correctly in a grinding machine for imparting to it the required contour, corresponding to the shape of the chosen frame. This pin is usually stuck temporarily to the lens by means of a double-sided adhesive. The lens equipped in this way is then placed in the trimming machine, where it is given a shape corresponding to that of the chosen frame. The lens then defines a geometrical frame of reference in which characteristic points and directions of the lens are located, these being necessary for the lens to be coherent with the position of the pupil, as well as trimming values such that the characteristic points and directions are properly positioned in the frame.

If cutting the lens does not result in it being correctly mounted in the frame, the operator can carry out further machining. To this end, he can replace the lens in the machine using the same centering pin.

Depending on the organization and on the equipment available to the optician, the operations mentioned above can be distributed between two or three workstations. Errors are therefore possible, because of the increased number of manipulations. Moreover, if these operations are carried out in an industrial context, they result in a considerable waste of time and a high production cost. Furthermore, the risk of degrading the ophthalmic lens increases with the number of manipulations.

The invention optimizes the process described hereinabove by automating as much as possible the phases of measuring and positioning the ophthalmic lens, so that the optical characteristics of the lens can be determined and the phase of transporting the lens to the trimming station and the trimming phase as such can be monitored.

To this end, the invention essentially consists in an ophthalmic lens trimming device characterized in that it includes:

- detection means for detecting characteristics of said lens,
- means for taking into account characteristics representative of the morphology of a wearer,
- a support for a lens of this kind, mobile along at least one predetermined path in a first frame of reference between a predetermined measuring position relative to said detection means and a loading position,
- means for superposing the characteristics previously cited of said lens and characteristics representative of the morphology of said wearer,
- means for grinding the edges of said lens, and
- holding and gripping clamp means mobile in a second frame of reference tied to said first frame of reference for transporting said lens from said loading position to the grinding means.

In a relatively sophisticated and automatic embodiment, the means for superposing the characteristics previously cited can include calculation means for "superposing" data representative of the characteristics in question, and can be complemented by display means (for example a monitor) to enable an operator to monitor visually the superposition of a representation of said characteristics and where applicable a representation of the frame contour.

The holding and gripping means are advantageously adapted (i.e. motorized) to turn the lens about its holding point during the grinding phase.

The means for detecting characteristics of the ophthalmic lens can be semiautomatic or automatic. In the former case, the operator places the lens on the support at a measurement location. He uses an electronic and data processing system and a display screen to superpose a contour representative of the shape of the rim of the frame, certain optical characteristics of the ophthalmic lens in question, and information representative of the morphology of the wearer. The optician then moves the lens on its support until the characteristic points of said lens appear on the screen at suitable locations relative to a mark representative of the morphology of the wearer. Moreover, the contour representative of the frame determines the holding point of the lens. When the lens is correctly positioned on its support, the latter is moved along said predetermined path of the first frame of reference (this is typically a rectilinear displacement), so that holding and gripping clamp means can be applied to either side of the lens and the lens transported to the grinding means.

In one variant, the results of the readings and measurements effected on the lens enable the holding and gripping clamp means to grip the lens at an appropriate point without it being necessary to adjust the position of said lens on the support.

The invention will be better understood in the light of the following description of an ophthalmic lens trimming device according to the invention, the description being provided by way of example only and given with reference to the appended drawings, in which:

FIG. 1 is a diagrammatic general perspective view of a portion of the device;

FIG. 2 is a plan view of FIG. 1 with the lens support in a different position;

Figure 3:
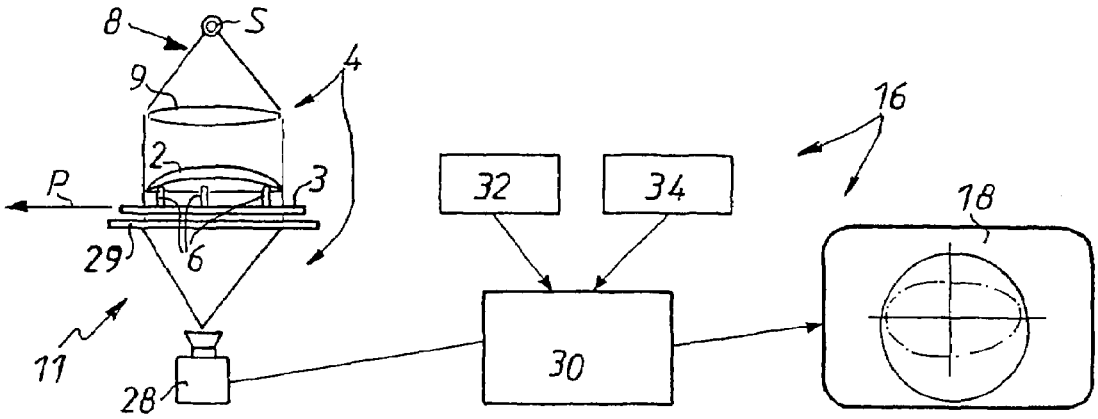
FIG. 3 is a diagrammatic view showing more particularly data capture means for detecting the main characteristics of the lens and positioning the lens relative to the contour of the chosen frame before trimming.

The trimming device 10 for trimming an ophthalmic lens 2 shown in FIGS. 1 to 3 includes a lens support 3 mobile along a predetermined path F, means 4 for detecting certain characteristics of the lens 2, calculation means 16, here including display means 18 consisting of a monitor screen, grinding means 20 for trimming the edge of the ophthalmic lens to the required shape and dimensions, and holding and gripping clamp means 25 for transporting the ophthalmic lens 2 from the support 3 to the grinding means 20.

The support 3 is mobile along said path F between a predetermined measurement position relative to said detection means 4 (FIGS. 1 and 3) and a loading position (FIG. 2).

In this example, said predetermined path is rectilinear; it is defined by two parallel slides 15*a*, 15*b* between which the support 3 moves. The support consists essentially of a plate at least a central portion of which is transparent, for example made of glass. This plate moves in its own plane between the slides.

The drive means for the support are not shown, to avoid overcomplicating the drawing. The plate has projections 6 forming a tripod to hold the lens. The slides that define the path F materialize a first frame of reference specific to the support 3, which here moves between the predetermined measurement position relative to said detector means 4 and said loading position. The support 3 thus has a two-fold function. It holds the lens throughout the phase, without interfering with the measurements, because of its particular structure (i.e. its transparency), after which it transports the lens to a precise location where it is taken up by the holding and gripping clamp.

The means 4 for detecting characteristics of the lens include, on respective opposite sides of said predetermined position of the support, firstly, illumination means 8 including a light source S and a collimator lens 9 adapted to produce a complete parallel beam illuminating the lens and, secondly, analysis means 11 for analyzing the image transmitted by the lens installed on the support 3. In this example, the analysis means include an optical receiver 28 and a translucent screen 29 disposed between the support and the optical receiver. The translucent screen 29 can be a glass plate with a frosted surface. To enhance the readability of the information that appears on the frosted screen 29, the latter can be a disk that is mounted so that it can turn and is driven in rotation in its own plane. The optical receiver 28 can be a matrix receiver or, as shown here, a video camera. The optical axis of the receiver is perpendicular to the support 3 and passes through the center of the collimator lens 9. The screen 29 is perpendicular to this optical axis.

The video camera captures the image of the lens that is formed on the frosted screen. The information generated by the video camera is sent to the calculation and display means 16, 18. It is processed by an electronic and data processing system 30 which also receives information representative of the parameters mentioned above (interpupillary distance and pupil height), by way of a transmission device 32, and information representative of the contour of the chosen frame. This information is held in a memory 34, for example, and selected by the practitioner. The electronic and data processing system 30 generates an image that is displayed on the monitor screen of the display means 18. Consequently, in a version with semiautomatic adjustment, there are seen in particular on this screen, to the same scale, the contour of the frame and that of the untrimmed lens, with its particular characteristics, in particular the marking points that it carries. There are also seen the holding point 0 determined as described above and the point or points representative of the morphology of the wearer.

The transparent support 3 includes an access cut-out 38 enabling said holding clamp means 25 to grip the lens at a required place on its surface and to remove it from the support when the latter is at the loading position, in order to move said ophthalmic lens to the vicinity of the grinding means, in order to proceed with the trimming of the lens.

The holding and gripping clamp means 25 move in a second frame of reference to transport said ophthalmic lens from said loading position to said grinding means.

To be more precise, these latter means include a generally C-shaped frame 39 mounted so that it can be rotated about a vertical axis 40 perpendicular to the plane of the support 3. Rotation of the frame moves a lens 2 gripped by the holding clamp into an activity area of the grinding means. The frame includes two arms 45, 46 extending on respective opposite sides of the horizontal plane in which the support 3 moves. The lower arm 45 carries a gripping and rotation driving shaft 48 and the other, upper arm 46 carries a rotation driving shaft 49. In other words, once the ophthalmic lens has been gripped, the two shafts 48, 49 are coupled to common rotation driving means accommodated inside the frame 39. The two shafts are coaxial and provided at their facing ends with clamping shoes 50 for holding and immobilizing an ophthalmic lens 2 taken from the support 3. The clamping shaft 48 is moved along its own axis to hold and immobilize the ophthalmic lens. The pivot axis 40 of the frame is parallel to the common axis of the shafts 48 and 49. Furthermore, the frame 39 as a whole is mobile and driven in translation along its axis 40 (direction Z).

In fact, an ophthalmic lens grinding machine generally includes an axially stacked plurality of grinding wheels, namely two grinding wheels for the blank (one for plastics materials and one for mineral glass), a finishing grinding wheel, and possibly a polishing grinding wheel. To carry out the various machining phases, the lens must pass over two or three grinding wheels in succession. To this end, it is therefore necessary to provide for relative movement in translation between the grinding wheels and the lens in a direction parallel to the axis of the grinding wheels. Moreover, to retain the lens in a frame rim with a closed contour, a bevel must be formed on its edge. This shape is produced by the finishing grinding wheel, and where applicable the polishing grinding wheel, which has on its periphery a recess of complementary shape to that of the bevel. The same movement in translation of the lens relative to the grinding wheel is used to position this bevel correctly on the edge of the lens.

This relative movement could be achieved by moving the support of the grinding wheels in translation along their axis.

In the present example, however, it is the frame 39 that performs this movement, in order to facilitate holding the lens. In fact, once the lens has been positioned manually or measured and the support 3 is in the loading position, the frame 39 turns about its axis 40 to position the shafts 48 and 49 in front of the holding point, and then moves downward in translation to bring the shoe 50 on the shaft 49 into contact with the lens. The shoe on the shaft 48 then clamps the lens. The frame then moves upward along its axis 40, removes the lens 2 from the support 3, and then turns about the same axis to position the lens in the grinding area.

The frame can then pivot through approximately 120° to 150° to move the lens to be trimmed into the vicinity of the grinding machine. During trimming, the electronic and data processing system 30 controls both the pivoting of the frame and the rotation of the lens about the common axis of the two shafts 48, 49 as a function of the contour to be imparted to the ophthalmic lens. The holding and gripping clamp means 25 move the lens in said second frame of reference to transport the lens from the loading position to the grinding means and thereafter to turn the lens about the common axis of the two shafts. The second frame of reference is tied to the first frame of reference, i.e. the support frame of reference. During grinding, the distance between the common axis of the two shafts 48, 49 and the rotation axis of the grinding means 20 is controlled synchronously with the rotation of the lens about said common axis to impart the required contour to the lens. In other words, the pivoting of the frame 39 is controlled during grinding.

Figure 4:
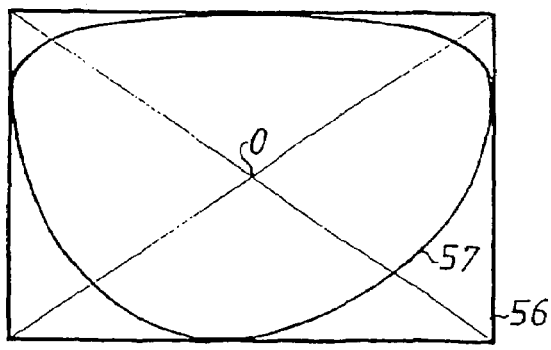
FIG. 4 is a diagram showing how the holding point of the lens relative to the contour of the frame is determined.

In FIG. 4, the center 0 of the rectangle 56 that frames the perimeter of the rim 57 of the frame and consequently represents the final shape of the ophthalmic lens is the point on the ophthalmic lens to which the clamping shoes 50 of the holding clamp means 25 have just been applied.

How the device that has just been described is used to facilitate the positioning of the lens on the support 3 for automatic trimming thereof is explained next.

The ophthalmic lens 3 can be of several types. If it is a monofocal lens, the optician must mark its optical center and, where applicable, the axis of the cylinder, for correcting astigmatism, using a device known in the art as a focimeter. This device is used to deposit three aligned points on the surface of the lens. The central point corresponds to the optical center of the lens and the other two indicate the axis of the cylinder. A progressive lens is generally shipped with ink markings for locating the points necessary for centering. These marks typically materialize the center of distant vision, the axis of progression and the area of near vision. In the case of a bifocal or trifocal lens, the near vision "patch" is taken as a reference for centering.

The optician also has a digitized version of the shape of the chosen frame (in the memory 34), so he can enter that shape into the electronic and data processing system 30, in the form of data for displaying the contour of the rim on the screen of the display means 18. The optician also enters into the electronic and data processing system 30 interpupillary distance and pupil height values measured on the wearer. A keyboard or some other device 32 constitutes a suitable interface for taking account of and entering into the system 30 the characteristics representative of the morphology of the wearer. The shape representative of the frame is displayed on the screen and is positioned so that the center O of the rectangle in which the rim is inscribed corresponds to a particular point that will be the holding point of the lens on the support 3 when the support is at said loading position (see FIG. 4). As a function of the data specific to the wearer, a centering cross appears on the screen. For example, the cross corresponds to the optical center of the lens for a monofocal lens, to the distant vision point for a progressive lens, or to the position of the center of the segment of the patch for a bifocal or trifocal lens. Furthermore, the electronic and data processing system "receives the image" of the lens via the receiver 28, and that image can therefore be superposed on those already displayed on the screen. From this moment on, the optician can therefore vary the position of the lens on the support 3 to position the markings applied to the lens relative to the centering cross. Because the rim of the frame is shown, it is possible to check that the lens is large enough to fit.

Once the lens is correctly positioned, in theory there is nothing else for the optician to do, as the support 3 is moved toward the loading position, at which the lens is taken up by said holding and gripping clamp means 25 and then transported to the grinding means. In the example shown, the carriage moves in translation and the holding and gripping clamp means perform two rotations and one movement in translation, namely a rotation about the axis 40 of said mobile frame, a rotation about the common axis of the two shafts 48, 49, and a movement in translation in the direction Z. Other embodiments featuring other combinations of movement in translation and rotation can be envisaged.

Figure 5:
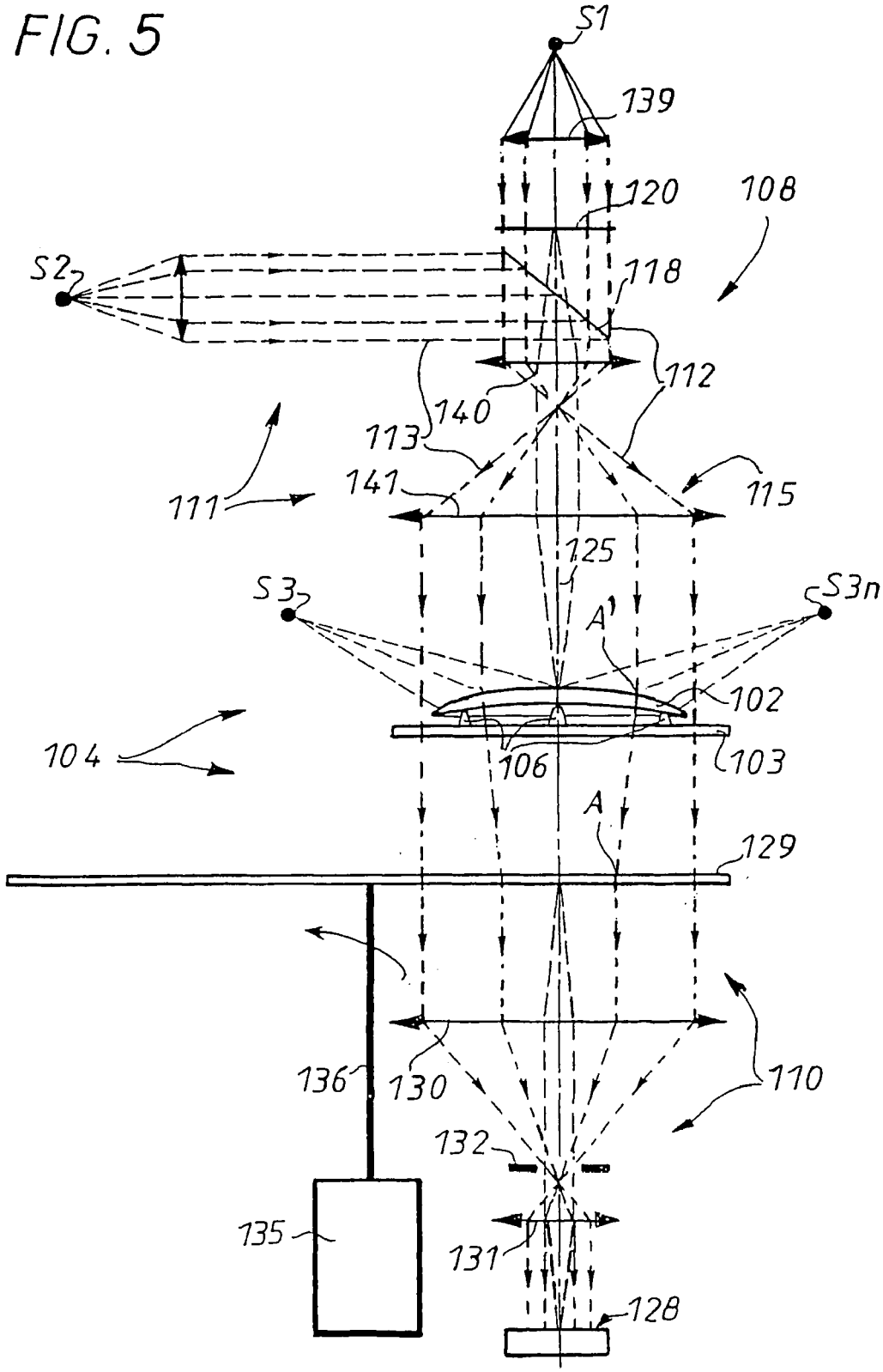
FIG. 5 is a diagram showing a variant of the means for detecting characteristics of said ophthalmic lens.

A device 104 for automatically detecting characteristics of an ophthalmic lens constituting an improved variant of the lens characteristic detection means shown in FIG. 3 are described next with reference to FIG. 5. With this kind of automatic detection device, the electronic and data processing system 30 can analyze the image of the lens more completely and, for example, recognize automatically marks applied to the lens or the segment of a bifocal lens. In other words, as soon as the lens is placed on the support 103, analyzing the image determines the position of the marks on the lens in the frame of reference of the support. The system can then calculate the position of the clamping center of the lens so that the optical center of the lens or another centering mark is correctly positioned in the frame. The holding and gripping clamp means grip the lens at this point.

The device 104 for automatically detecting characteristics of an ophthalmic lens 102 includes a support 103 which in this example is horizontal and consists of a transparent glass plate with projections 106 forming a tripod to hold the lens and, on respective opposite sides of said support, firstly, illumination means 108 including an optical system for producing a light beam directed toward the lens installed on the support and, secondly, analysis means 110 for analyzing the image transmitted by the lens installed on the support.

The optical system 111 is adapted to define two switchable optical paths 112, 113 for said light beam. In the example shown, the illumination means include at least two switchable light sources S1, S2 respectively corresponding to the two optical paths previously cited. In other words, when the source S1 is turned on the source S2 is turned off, and vice-versa. The two optical paths 112, 113 have a common portion 115 upstream of said support, to be more specific between a semireflecting mirror 118 and the sensor 128. The mirror materializes the intersection of the two optical paths. The mirror can be replaced by a splitter cube or a removable mirror.

According to one important feature of this embodiment, a mask 120 forming a Hartmann matrix or the like is placed on only one of the paths (here the path 112), at a location such that it occupies a predetermined position relative to an optical axis 125 of said analysis means 110. The optical axis 125 is in fact the common axis of certain lenses of the optical system centered relative to the source S1 and of an optical receiver 128 forming part of the analysis means 110 on the other side of the support 103. The analysis means also include a frosted translucent screen 129 perpendicular to the optical axis 125 disposed between the support 103 and said optical receiver 128. The latter can be a matrix sensor or a video camera with an objective lens. If the optical receiver is a matrix sensor, a telecentric system of two lenses 130, 131 and a diaphragm 132 is added to it. If the optical receiver is a video camera, the above components are replaced by the objective lens of the camera itself. The frosted translucent screen 129 is preferably made of glass or the like with a frosted surface. It is a disk mounted so that it can turn and is driven in rotation by a motor 135 about an axis 136 parallel to and spaced from the optical axis 125.

Returning to the optical system 111 associated with the light sources S1 and S2, the first light source S1 is a point source associated with at least one collimator lens 139 adapted to produce a complete parallel beam illuminating the mask 120. The source S1 is used to establish a kind of map of the lens (measurement of power/astigmatism at several points on the lens), to determine the optical center of non-progressive lenses, and to reposition on the front face of the lens the objects (engraved or printed marks, segment) viewed with the source S2. The source S1 can be mobile along the optical axis or an axis perpendicular thereto. The collimator lens 139 is centered on the optical axis previously cited. The optical system further includes an expander consisting of two lenses 140, 141 also centered on the optical axis previously cited and placed between the mirror and the support. The expander is used to generate a parallel light beam with larger dimensions, greater than those of the ophthalmic lens, and to image the mask 120 on the surface of the lens.

A second light source S2 is adapted to illuminate the lens 102 installed on the support 103 via a portion of the optical system excluding the mask 120 forming the Hartmann matrix. The second light source is associated with the semireflecting mirror 118 that materializes the intersection of the two optical paths 112, 113. The source S2 is a point source associated with at least one collimator lens adapted to provide a complete parallel beam directed toward the mirror 118. The beam generated by the lens S2 [sic] is perpendicular to the beam generated by the lens S1 [sic] and the mirror is at an angle of 45° to the optical axis 125 with the result that the complete parallel beam from the source S2 is reflected from the mirror and directed toward the support 103 of the ophthalmic lens. On the other hand, downstream of the mask 120, the light emitted by the source S2 is divided into separate parallel light rays at the exit of the expander 140, 141.

As emerges hereinafter, the source S2 is mainly used to determine printed marks, engraved marks in relief, and segments (bifocal and trifocal lenses). On the other hand, a mineral glass ophthalmic lens has diffusing engraved marks. In this case, it is necessary to illuminate the lens 102 at grazing incidence for certain operations. This is why the device includes at least one third light source, in this example a plurality of sources S31, S3*n* distributed in a circle, at the periphery of the support 103, to illuminate at grazing incidence a lens of this kind placed on said support. In this case, the light rays must not be diffused by the frosting, and it is therefore necessary to provide either a retractable frosted glass or a glass having a frosted region used only in this case.

The light sources S1, S2 mentioned hereinabove can be light-emitting diodes (LED) or laser diodes, preferably associated with respective optical fibers. The sources S31, S3*n* are preferably light-emitting diodes.

How the device can be used to determine a certain number of characteristics of the ophthalmic-lens placed on the support is described next.

1/Identification of the ophthalmic lens

To avoid errors, it is beneficial to be able, before anything else, to recognize the type of ophthalmic lens that is being analyzed (monofocal, multifocal or progressive). To this end, the source S1 is used with the mask forming a Hartmann matrix. The complete parallel beam is converted by the mask 120 into a plurality of fine individual rays corresponding to the configuration of the mask. Each of these rays impinges on the entry face (front face) of the lens, parallel to the optical axis. The rays are deflected by the lens and are viewed in the form of light spots on the rotating frosted screen 129. The frosting is imaged on the matrix sensor with the associated telecentric system or on the video camera, and the spots are analyzed by an electronic and data processing system 16 (FIG. 2), which determines their displacement.

If the lens is of the monofocal type, the displacement of the points of the mask (i.e. the light spots that appear on the frosted screen) after deflection by the lens compared to the positions of the same points when the support is not carrying any ophthalmic lens is in linear progression from the center toward the periphery. The positions of the points of the Hartmann mask on the screen when the support is not carrying any lens are measured during a calibration phase. Consequently, measuring the above displacement determines the type of lens. For example, for a convergent lens, the spots move toward the optical axis, increasingly so as the power of the lens increases.

2/Determination of the Progression Line of a Progressive Lens

Under the measurement conditions indicated hereinabove, it is observed that for a progressive lens the displacement of the points varies along a line referred to as the "progression line". To determine the progression line, the direction of the power gradient is determined by calculating the power at different points on the lens, for example using the method indicated later. This direction is the progression line. It is therefore possible to measure and calculate the orientation of the progression line, which is one of the important characteristics of a progressive lens. It is to be noted that the calculations are based on two series of data, firstly the configuration of the points of the Hartmann mask on the frosted screen when there is no ophthalmic lens on the support and secondly the corresponding configuration of the same points resulting from deflection of all of the rays by the ophthalmic lens.

3/Determination of the Optical Center of a Non-progressive Lens

If the ophthalmic lens 102 has been identified as of the monofocal type, the position of the optical center of the lens can easily be determined by comparing the points of the reference mask (appearing on the frosted screen 129 when there is no lens on the support) and the corresponding points of the mask viewed on the frosted screen after deflection by the lens. In principle, the point of the mask that has not been deflected corresponds to the position of the optical center. As there is generally no ray that has not been deflected at all, in fact interpolation from the least deflected rays is used, for example by application of the least squares method.

4/Calculation of the Power and the Astigmatism of the Lens

It is known that for a monofocal lens the distance between the focus and the rear face of the lens represents the power.

The position of the rear face of the lens is given to a good approximation by the position of the support, since the lens is placed on it. The image on the frosted screen of the mask forming the Hartmann matrix is again used to determine the focus. To this end, the position of the corresponding points is compared between the calibration image before placement of the lens and the image after placement of the lens. The position and the direction of the light rays are compared for a plurality of nearby points to calculate the position of the focus on the optical axis (and therefore the power, which is the reciprocal of the distance from the focus to the lens) and the astigmatism of the lens (astigmatism value and axis), if there is any astigmatism. These measurements are local and can be repeated in different regions of the lens, to obtain a map of the power of the lens.

5/Determination of the Prism Reference Point and the Horizontal Axis of a Progressive Lens It is known that at any point on an ophthalmic lens the front face and the rear face can be considered to be at an angle similar to that of a prism. Also, the addition of a progressive lens is defined as the difference between the maximum power and the minimum power of the lens. By convention, the prism reference point is defined as the point at which the prism of the lens is two-thirds of the addition.

On a progressive lens, the prism reference point (PRP) is the center of a segment between two engraved marks on the lens. This point is usually also identified by a specific printed mark. The PRP is located by illuminating the lens with the light source S2, i.e. without the Hartmann mask 120. The image transmitted by the ophthalmic lens appears on the frosted glass 129 and is picked up by the optical receiver 128. Reading is accompanied by appropriate image processing to improve the definition of the engraved or printed marks. This viewing of the engraved or printed marks and determination of the PRP provide for subsequent determination of the centering point of the progressive lens (analogous to the optical center), at which the position of the center of the pupil of the eye of the wearer and the horizontal axis that defines the orientation of the lens in the frame must coincide.

6/Determination of the Shape and the Dimensions of the Lens

These characteristics are determined by illuminating the ophthalmic lens using the source S2 and carrying out appropriate image processing to improve the definition of the contours of the lens. Before trimming, the lens is generally circular, and the main object of this analysis is to determine its diameter. However, the lens may already have a shape close to that of the frame for which it is intended. Image processing determines the shape and the dimensions of the noncircular lens. Determining the shape and the dimensions of the lens verifies that it is sufficiently large to be retained in the frame.

7/Determination of the Position of the Segment of a Bifocal Lens

The source S2 is again used to display the ophthalmic lens on the frosted screen. Appropriate image processing makes it easier to observe the luminous intensity variations on the screen and consequently produces a sharp contour of the limits of the segment and determines its position precisely.

It is to be noted that for all the parameters indicated hereinabove that are acquired by illuminating the ophthalmic lens using the light source S2, i.e. excluding the Hartmann mask, it is possible to process the measurements to "transfer" the positions of the engraved or printed marks or the segment read on the frosted screen to the front face of the ophthalmic lens. The source S2 enables the engraved or printed marks or the segment to be seen, but does not enable their positions on the front face of the lens to be determined. However, the source S1 enables the precise position on the front face of the lens of these elements acquired with the source S2 to be determined. The procedure is as follows: assume that the light spot A on the frosted screen 129 corresponding to one of the holes of the Hartmann mask is being considered. The corresponding light ray impinges on the front face of the lens 102 at A'. In a first step, the source S2 is turned on and the corresponding image that appears on the frosted screen is memorized. Then the source S1 is turned on and the source S2 is turned off. The image of the Hartmann mask therefore appears on the frosted screen 129. The height of each hole of the Hartmann mask (the distance of the hole from the optical axis 125) is known. Consequently, for a given radius, and given that the characteristics of the expander 140, 141 are known, the height of the ray corresponding to the point at which it impinges on the front face of the ophthalmic lens 102 is known. In other words, the height of the point A' corresponding to the point A is known. Consequently, a correction can be applied to the point A to determine the point A'. It is therefore possible to locate on the lens itself the position of any mark read on the frosted screen, which makes this measurement more precise. In other words, the use of a Hartmann mask placed upstream of the ophthalmic lens in conjunction with a light source S1 improves all measurements that are effected by illuminating the lens with a source S2 and using an optical path excluding said mask.

As previously mentioned, the conditions under which the measurements using the source S2 are normally effected can be improved, if the ophthalmic lens is a mineral glass lens, by replacing the source S2 with one or more sources illuminating the front face of the ophthalmic lens at grazing incidence.

In conjunction with the data acquired by the transmission device 32 and the memory 34, the acquisition of the measurements indicated hereinabove determines the exact holding point of the ophthalmic lens on the support 3 when moved to said loading position and controls all movements of the frame 39 during trimming (pivoting about the axis 39 and rotation of the lens). With an embodiment of this kind, the monitor 18 is optional.

The invention claimed is:

1. An ophthalmic lens trimming device characterized in that it includes:

detection means (4, 104) for detecting characteristics of said lens, means (32) for taking into account characteristics representative of the morphology of a wearer, a support (3, 103) for a lens of this kind, mobile along at least one rectilinear predetermined path in a first frame of reference between a predetermined measuring position relative to said detection means and a loading position, means (16) for superposing the characteristics previously cited of said lens and characteristics representative of the morphology of said wearer, means (20) for grinding the edges of said lens, and holding and gripping clamp means (25) separate from said support (3, 103) and mobile in a second frame of reference tied to said first frame of reference for transporting said lens from said loading position to the grinding means.

2. A device according to claim 1, characterized in that said holding and gripping clamp means (25) are adapted to turn said lens about its holding point.

3. A device according to claim 1, characterized in that said means (16) for superposing said characteristics include display means (18).

4. A device according to claim 1, characterized in that said support (3, 103) is transparent and has an access cutout (38) allowing said holding clamp means to grip said lens at a required place on its surface and to remove it from said support.

5. A device according to claim 4, characterized in that said support includes a transparent plate mobile in its own plane along rectilinear guide means (15*a*, 15*b*).

6. A device according to claim 5, characterized in that said transparent plate has projections (6, 106) forming at least one tripod for holding a lens as previously cited.

7. A device according to claim 1, characterized in that said detection means (4) include at least means for displaying a lens as previously cited including, on respective opposite sides of said support when the latter is in said predetermined position, firstly, illumination means (8) and, secondly, analysis means (11) for analyzing the image transmitted by a lens of the above kind installed on said support.

8. A device according to claim 7, characterized in that said analysis means include a frosted translucent screen (29) disposed perpendicularly to an optical axis of said analysis means between [sic] a point situated between said support and an optical receiver.

9. A device according to claim 8, characterized in that said frosted translucent screen is mounted so that it can turn and is driven in rotation about an axis parallel to said optical axis and spaced therefrom.

10. A device according to claim 8, characterized in that said optical receiver is a matrix sensor or a video camera (28).

11. A device according to claim 1, characterized in that said detection means (104) include, on respective opposite sides of said predetermined position of said support, firstly, illumination means (108) including an optical system for generating a light beam directed toward a lens installed on said support and, secondly, means (110) for analyzing the image transmitted by said lens installed on said support, in that said optical system is adapted to define two switchable optical paths (112, 113) for said light beam, and in that a mask (120) is placed on only one of the paths, at a location such that it occupies a predetermined position relative to an optical axis (125) of said analysis means.

12. A device according to claim 11, characterized in that the two optical paths (112, 113) have a common portion upstream of said support.

13. A device according to claim 11, characterized in that said illumination means include at least two suitable light sources (S1, S2) respectively corresponding to the two optical paths previously cited.

14. A device according to claim 13, characterized in that, of said two light sources, a first source (S1) is a point source associated with at least one lens adapted to produce a parallel beam illuminating said mask.

15. A device according to claim 13, characterized in that, of said two light sources, a second source (S2) is adapted to illuminate said lens installed on said support via a portion of said optical system excluding said mask.

16. A device according to claim 15, characterized in that said second light source (S2) is associated with a semireflecting mirror (118) disposed between said mask and said support and materializing the intersection of the two optical paths previously cited.

17. A device according to claim 15, characterized in that said second source (S2) is a point source associated with at least one lens adapted to produce a parallel beam directed toward said mirror (118).

18. A device according to claim 16, characterized in that an expander (140, 141) is placed between said mirror and said support.

19. A device according to claim 13, characterized in that it includes at least one third light source (S31, S3*n*) placed at the periphery of said support 103 to illuminate a lens placed on said support with grazing incidence.

20. A device according to claim 11, characterized in that said analysis means include a frosted translucent screen (129) disposed perpendicularly to said optical axis between said support (103) and an optical receiver (128).

21. A device according to claim 20, characterized in that said frosted translucent screen (129) is mounted so that it can turn and is driven in rotation about an axis parallel to said optical axis and spaced therefrom.

22. A device according to claim 20, characterized in that said optical receiver (128) is a matrix sensor or a video camera.

23. A device according to claim 1, characterized in that the holding clamp means include a mobile frame (39), in that said frame has two arms (45, 46) on respective opposite sides of a plane in which said support moves, in that one of the arms carries a gripping shaft (48), and in that the other arm carries a rotation driving shaft (49), the two shafts being coaxial and provided at their facing ends with gripping shoes (50) for holding and immobilizing an ophthalmic lens.

24. A device according to claim 23, characterized in that said frame is mounted so that it can be driven in rotation about an axis (40) perpendicular to the previously cited plane of said support, the rotation of said frame moving a lens gripped between the two shafts into an activity area of the grinding means (40) and the pivoting of the frame being controlled during grinding.

25. A device according to claim 23, characterized in that said clamping shaft (43) is mounted to be driven in translation along its own longitudinal axis.

26. A device according to claim 23, characterized in that said rotation drive shaft (49) is mounted so that it can be driven in rotation about its own longitudinal axis.

27. A device according to claim 11, wherein said mask (120) forms a Hartmann matrix.

* * * * *